US007424935B1

(12) United States Patent
Smith

(10) Patent No.: US 7,424,935 B1
(45) Date of Patent: Sep. 16, 2008

(54) ELEVATOR DOOR ASSEMBLY

(75) Inventor: Stephen W. Smith, Arkansas City, KS (US)

(73) Assignee: Columbia Elevator Solutions, Inc., Winfield, KS (US)

( * ) Notice: Subject to any disclaimer, the term of this patent is extended or adjusted under 35 U.S.C. 154(b) by 330 days.

(21) Appl. No.: 11/295,899

(22) Filed: Dec. 7, 2005

(51) Int. Cl.
*B66B 13/06* (2006.01)

(52) U.S. Cl. ..... 187/333; 187/334; 49/125; 49/409; 49/425

(58) Field of Classification Search ..... 187/333, 187/334; 49/120, 125, 323, 370, 404, 409, 49/425; 160/196.1, 202, 228
See application file for complete search history.

(56) References Cited

U.S. PATENT DOCUMENTS

| | | | | |
|---|---|---|---|---|
| 1,685,081 | A | 9/1928 | Brady | |
| 2,271,998 | A | 2/1942 | Dunn | |
| 2,328,326 | A | 8/1943 | Byrne | |
| 2,372,648 | A | 4/1945 | Beskin | |
| 3,072,394 | A | 1/1963 | Urquhart | |
| 3,425,160 | A | 2/1969 | Petterborg | |
| 3,425,162 | A * | 2/1969 | Halpern | 49/425 |
| 3,577,679 | A | 5/1971 | Petterborg | |
| 4,073,034 | A * | 2/1978 | Martens | 16/87 B |
| 4,355,486 | A * | 10/1982 | Sherwood | 49/409 |
| 4,588,049 | A * | 5/1986 | Haas | 187/324 |
| 5,060,763 | A | 10/1991 | Garrido et al. | |
| 5,606,826 | A * | 3/1997 | Calhoun | 49/138 |
| 5,673,770 | A | 10/1997 | Friedman | |
| 5,839,543 | A | 11/1998 | Chiu | |
| 2004/0079592 | A1 * | 4/2004 | Borneck | 187/318 |
| 2004/0149522 | A1 * | 8/2004 | Miller | 187/333 |
| 2006/0000563 | A1 | 1/2006 | Ito | |

FOREIGN PATENT DOCUMENTS

| | | |
|---|---|---|
| EP | 0236909 | 9/1987 |
| EP | 90870180.8 | 4/1991 |
| JP | 05-289223 | 5/1995 |
| WO | WO2004/050529 A1 | 6/2004 |

* cited by examiner

*Primary Examiner*—Peter M. Cuomo
*Assistant Examiner*—Stefan Kruer
(74) *Attorney, Agent, or Firm*—Kenneth H. Jack; Davis & Jack, L.L.C.

(57) ABSTRACT

A door assembly for an elevator having a cab having a cab entry, the elevator having an elevator shaft having upper and lower shaft entries, the assembly incorporating first, second, and third ladder frames having a plurality of roller carrying rungs and bolt and spacer sleeves spanning between the ladder frames' rungs, each ladder frame having proximal and distal ends, the first ladder frame overlying and extending outwardly from the elevator's cab entry, the second ladder frame overlying and extending inwardly from the elevator's upper entry, and the third ladder frame overlying and extending inwardly from the elevator's lower entry; the door assembly incorporating first, second, and third pluralities of rollable trolleys mounted upon the first, second, and third ladder frames' pluralities of roller carrying rungs; and the door assembly incorporating first, second, and third pluralities of door panels, suspending from the first, second, and third pluralities of rollable trolleys.

11 Claims, 4 Drawing Sheets

ELEVATOR DOOR ASSEMBLY

FIELD OF THE INVENTION

This invention relates to elevators or lifts installed within buildings. More particularly, this invention relates to machinery and assemblies associated with such elevators or lifts which are adapted for protectively opening and closing elevator cab and elevator shaft entries.

BACKGROUND OF THE INVENTION

Where a multi-storied building incorporates an elevator or lift, the elevator typically constitutes the most mechanically complicated and most expensive component of the building. Construction budgets for multiple storied residential homes have historically been more restricted than construction budgets of multiple storied commercial buildings. Accordingly, elevators have historically been less commonly installed within multiple storied homes than multiple storied commercial buildings. Where an elevator is installed within a commercial building, mechanical components such as the elevator's door assembly commonly comprises a superior, though mechanically complex and typically expensive, telescoping pocket door assembly. In contrast, where an elevator is installed within a multiple story residential home, such elevator's door assembly commonly comprises functionality inferior scissor bar gates or swinging doors chosen as a result of such typically reduced construction budget. The different economies of commercial versus home construction has historically relatively compromised the functionality of home elevator door assemblies in pursuit of lower cost.

The typically small size of residential elevator shafts and elevator cabs has historically further driven such compromises against functionality in home elevators. Wall spaces and elevator shaft spaces which are typically available within a common multi-storied residential home will often fail to accommodate types of functionally superior elevator doors which are commonly installed within a commercial building. For example, an elevator door assembly for a small elevator in a commercial building commonly comprises single sliding or pocket door panels which, in their opened positions, overlap portions of a wall of the cab or a wall of the elevator shaft. In contrast, cab wall and shaft wall spaces of a home elevator often fail to accommodate such overlapped positioning of such door panels. Accordingly, both the typical physical dimensions of homes and home construction economies have historically undesirably militated against the incorporation of functionally superior telescoping elevator door panel assemblies.

The instant invention solves or ameliorates problems discussed above by providing a telescoping elevator door assembly which achieves mechanical and cost economies through the provision of ladder frame roller track and header beam assemblies wherein the ladder frame incorporates a plurality of substantially identical and laterally co-extensive roller tracks.

BRIEF SUMMARY OF THE INVENTION

In a preferred embodiment of the instant inventive elevator door assembly, three telescoping panel doors are mechanically suspended and actuated for controlling a cab entry or a shaft entry of a small home elevator. Such three panel configuration is desirable since, upon telescoping retraction of the three panels to their opened positions, all three panels became longitudinally stacked and are laterally co-extensively aligned. In such stacked and aligned orientation, the panels extend only a minimal lateral distance along the elevator cab or shaft wall adjacent the entry. By minimizing such overlapped wall spaces through tripling the panels, the instant inventive elevator door assembly is more easily incorporated as a component of a common small home elevator.

Where the instant invention accommodates the preferred three telescoping door panels, a major structural component of the invention preferably comprises a horizontally cantilevered ladder frame having three distal roller carrying tracks serving as its laterally extending rungs. For the sake of enhanced economy in construction and fabrication, each of the roller carrying tracks or rungs is preferably configured substantially identically with each other roller carrying rung, each also being substantially laterally co-extensive with each other roller carrying rung. Preferably, each roller carrying rung presents an upwardly crowned roller bearing surface for rolling receipt and tracking support of reverse crown rollers, as will be discussed below. Also for the sake of economy in construction and fabrication, each of the roller carrying rungs preferably comprises an inverted "J" beam (i.e., having a "J" cross-sectional shape), such beams advantageously being fabricated through either a press brake forming or a roller forming process.

In addition to the three roller carrying rungs, the ladder frame of the instant inventive elevator door assembly preferably further comprises a door assembly support rung or header rung, such rung being positioned proximally from the preferred three roller carrying rungs.

The preferred ladder frame component of the instant inventive elevator door assembly further comprises rail means spanning between and rigidly interconnecting each of the rungs among the door assembly support rung and the preferred three roller carrying rungs. Suitably, the rail means may be configured similarly with the side rails of a conventional climbing ladder, such rails comprising rigid longitudinally extending beams which intermittently form rigid butt joints or "T" joints at the ends of the ladder frame's various rungs. However, in a preferred embodiment, the rail means comprises bolt and spacer sleeve combinations, the bolts extending longitudinally through quadruples of longitudinally aligned apertures within the door assembly support rung and roller carrying rungs, and the spacer sleeves rigidly longitudinally spacing and positioning such rungs along the longitudinal lengths of the bolts.

The above preferred embodiment of the instant inventive elevator door assembly preferably further comprises three rollable trolleys, each rollable trolley being mounted upon one of the roller carrying rungs among the preferred three roller carrying rungs. Preferably, each rollable trolley comprises a vertically oriented sheet steel plate, each supporting a pair of reverse crown rollers mounted upon a sidewall thereof, such reverse crown rollers advantageously nestingly receive the upwardly crowned roller track surfaces of the preferred inverted "J" beam roller carrying rungs, providing for smooth and noise-free lateral rolling motion.

The above described preferred embodiment of the instant inventive elevator door assembly preferably further comprises three elevator door panels, each panel among the three being fixedly attached to and suspending downwardly to floor level from one of the rollable trolleys.

In operation of the above preferred embodiment of the instant inventive elevator door assembly, the ladder frame's door assembly support rung or header rung is preferably fixedly attached either to an elevator's cab or to an elevator's shaft. Where the attachment is to the elevator's cab, the door assembly support rung is preferably positioned so that it overlies and extends longitudinally outwardly from the elevator cab's entry. Where the ladder frame is attached to the elevator's shaft, such frame is preferably positioned so that it overlies and extends longitudinally inwardly from one of the shaft's entries. For the sake of mechanical simplicity, the longitudinal inward or outward extension (as the case may be) of the ladder frame preferably is a cantilevered extension.

Actuator and motion control assemblies commonly known to those skilled in the elevator arts are typically installed upon the door assembly support rung of the ladder frame, such assembly operatively interconnecting with the rollable trolleys for alternately closingly extending the rollable trolleys along the three roller carrying rungs and openingly retracting the rollable trolleys along such rungs.

An elevator manufacturing or installation company utilizing and operating the instant inventive door assembly may advantageously maintain an inventory of substantially identical "J" beam roller carrying rungs, substantially identical "rail means" bolt and spacer sleeve combinations, and substantially identical door assembly support rungs or header rungs. Such replication of parts economically facilitates a typical basic installation of the instant inventive elevator door assembly as a component of a two level home elevator.

In such basic installation, the assembly preferably comprises first, second, and third ladder frames, each ladder frame being configured substantially identically with the single ladder frame rendition described above. In such home elevator, the first ladder frame is preferably installed so that it overlies and cantilevers longitudinally outwardly from the elevator cab's entry. The second ladder frame is preferably installed so that it overlies and cantilevers longitudinally inwardly from the upper elevator shaft entry, and the third ladder frame is similarly installed so it overlies and cantilevers longitudinally inwardly from the lower elevator shaft entry. First, second, and third groups of three rollable trolleys, and first, second, and third groups of three door panels, each configured as described above, are preferably respectively rollably mounted upon the first, second, and third ladder frames, as described above.

While the instant invention is considered to most advantageously incorporate longitudinally sequenced groups of three laterally co-extensive roller carrying rungs, rollable trolleys, and elevator door panels, the invention is considered to be applicable to configurations which include any multiple of, or to a general plurality of such components.

Accordingly, objects of the instant invention include the provision of an elevator door assembly comprising a ladder frame comprising substantially identical and substantially laterally co-extensive roller carrying rungs.

Other and further objects, benefits, and advantages of the instant invention have been described above, and will become known to those skilled in the art upon review of the Detailed Description which follows, and upon review of the appended drawings.

DETAILED DESCRIPTION OF A PREFERRED EMBODIMENT

Figure 1:
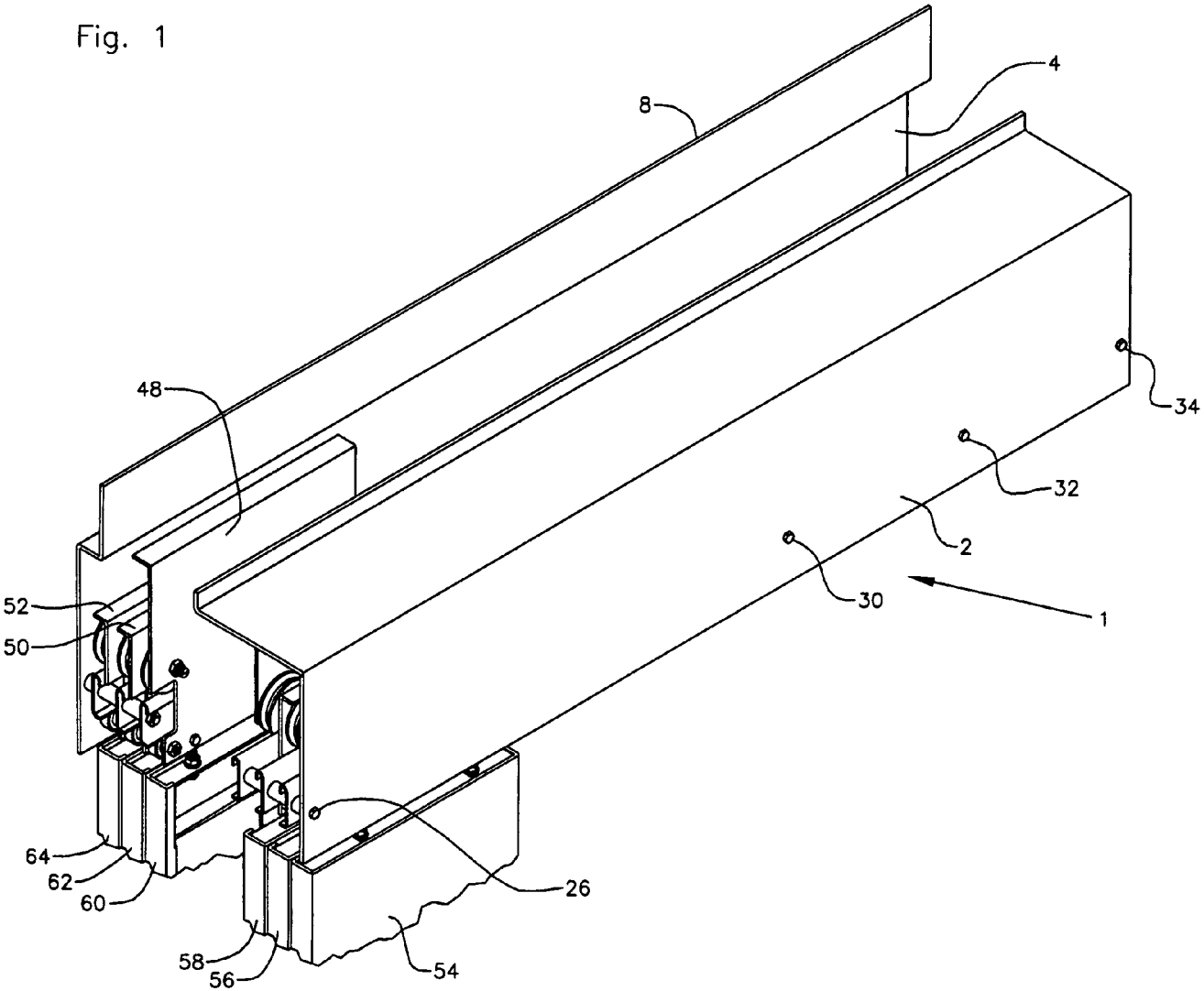
FIG. 1 is an isometric view of longitudinally paired cab entry and shaft entry renditions of the instant inventive elevator door assembly, the view showing suspended three panel elevator doors in their retracted opened positions.
Figure 2:
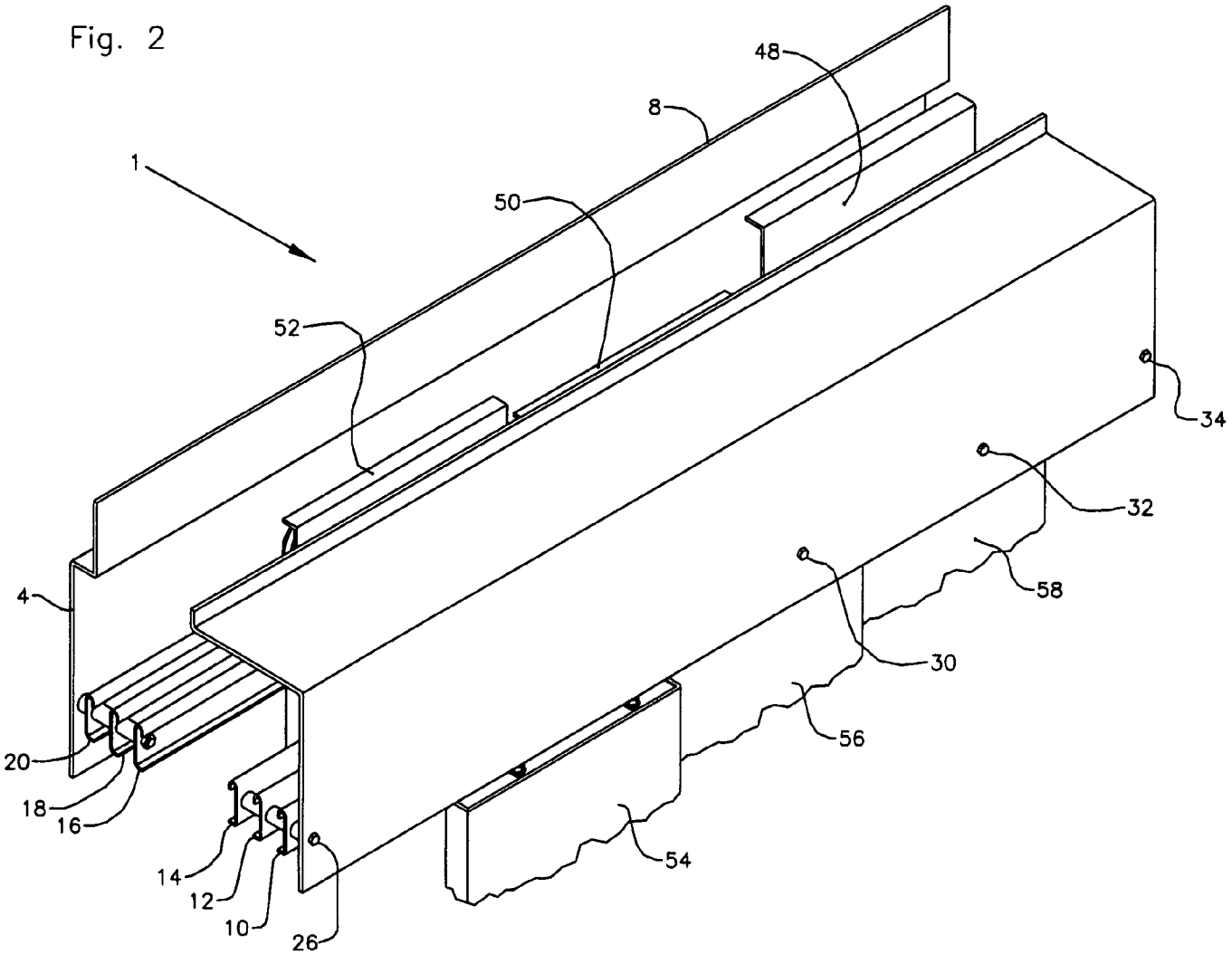
FIG. 2 redepicts FIG. 1, the view of FIG. 2 showing the elevator door panels repositioned in their extended closed positions.
Figure 3:
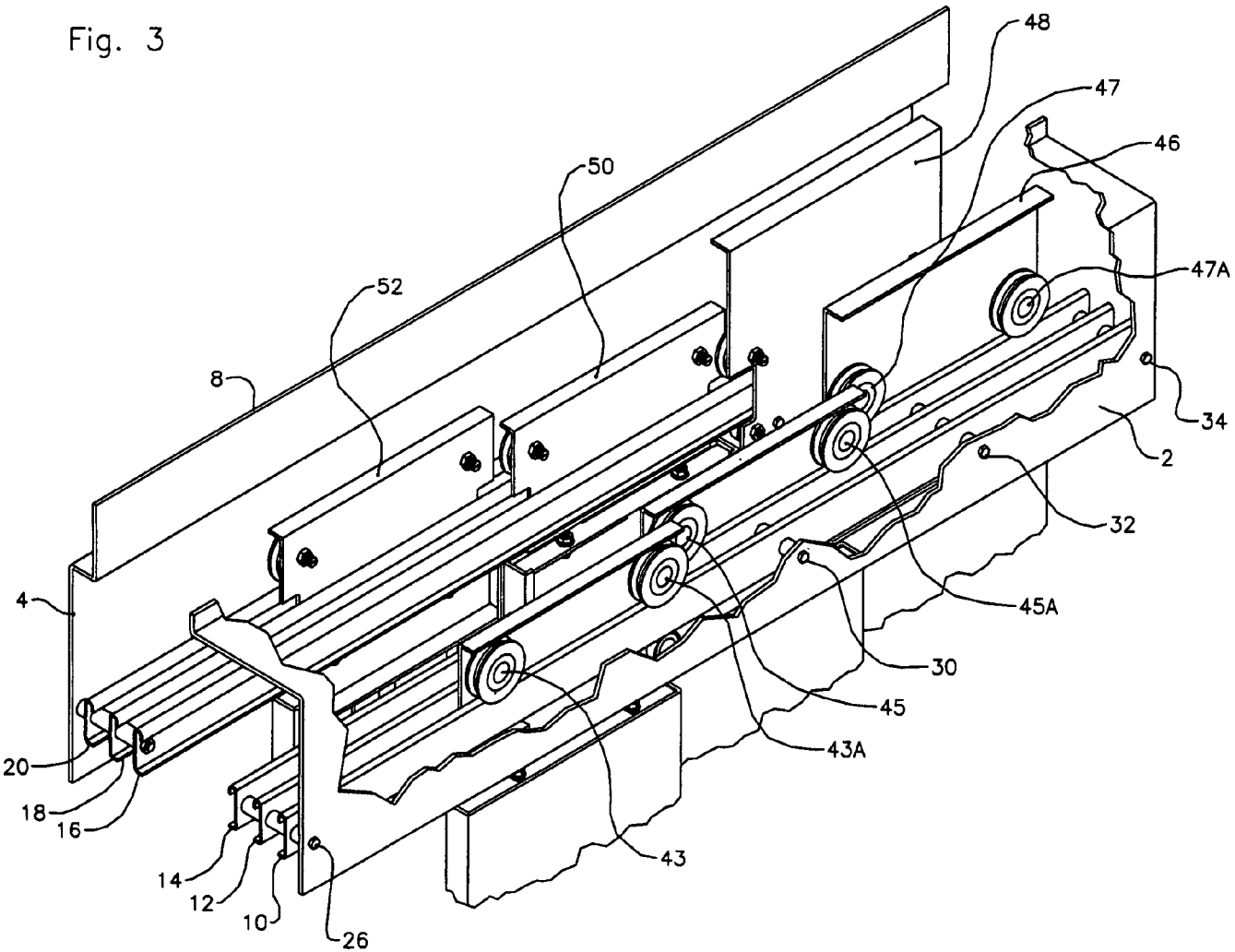
FIG. 3 redepicts FIG. 2, the view of FIG. 3 showing the shaft entry assembly's door assembly support rung with an explanatory cut-away portion for exposure of underlying structures.

Referring now to the drawings, and in particular simultaneously to FIGS. 1, 2, and 3, a preferred embodiment of the instant inventive elevator door assembly is referred to generally by Reference Arrow 1. A major structural component of the inventive elevator door assembly 1 constitutes a ladder frame including three roller carrying rungs 10, 12, and 14. The roller carrying rungs 10, 12, and 14 are preferably substantially identical and extend substantially laterally co-extensively. As is further shown in FIG. 4, each of the roller carrying rungs 10, 12, and 14 comprises an inverted "J" beam, each presenting an upwardly crowned roller bearing surface 22, and each having a web extending downwardly therefrom. Each rung among the three roller carrying rungs or "J" beams 10, 12, and 14 also preferably presents a retainer roller engaging flange 24 which extends laterally from the lower end of the web.

Referring further simultaneously to FIGS. 1-4, the ladder frame component of the instant invention preferably further comprises a proximally positioned door assembly support rung or header beam 2. The ladder frame preferably further comprises ladder rail means including bolts 26 and 34, such bolts extending longitudinally through quadruples of bolt receiving apertures (not within views), such apertures extending through the door assembly support rung 2 and through the roller carrying rungs 10, 12, and 14. Spacer sleeves 36, 38, and 40 mounted over the bolts 26 and 34 rigidly position the door assembly support rung 2 and the roller carrying rungs 10, 12, and 14, with respect to each other, such sleeves beneficially defining interstitial spaces between those components. Helically threaded nuts 27 are preferably threadedly mounted over the distal or inner ends of bolts 26 and 34, such nuts 27 directly compressing against the distal-most roller carrying rung 14, and successively and simultaneously compressing against the roller carrying rungs 10 and 12, and the spacers 36, 38, and 40.

Referring further simultaneously to FIGS. 1-4, the door assembly support rung 2 is exemplary, such rung being specially adapted for fixed attachment to an elevator shaft at a position overlying one of the shaft's upper or lower entries.

Figure 4:
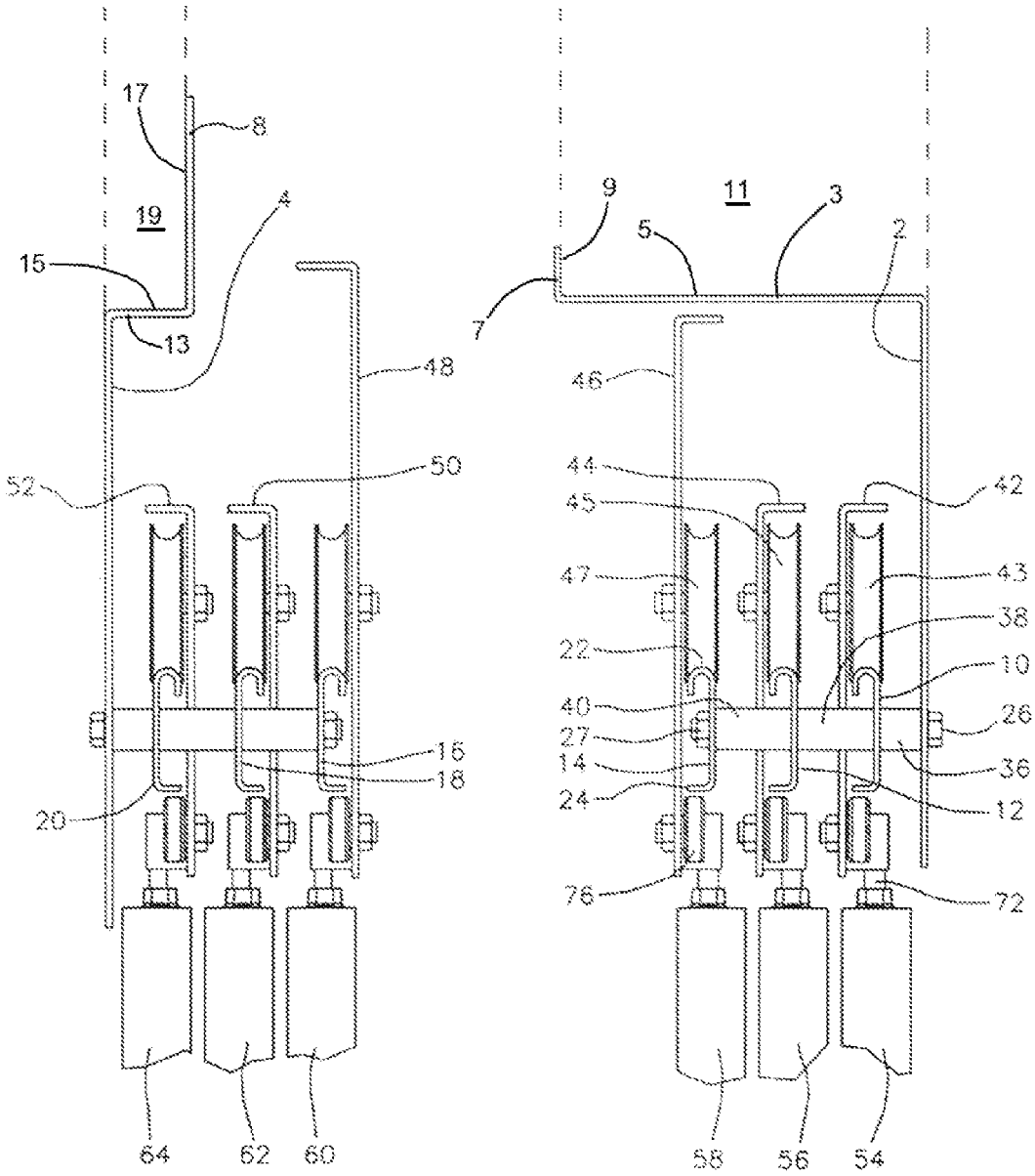
FIG. 4 is an end view of the assembly of FIG. 1.

Referring further simultaneously to FIGS. 1-4, the depicted preferred embodiment of the instant inventive elevator door assembly preferably further comprises three rollable trolleys 42, 44, and 46. The rollable trolley 42 preferably supports a pair of reverse crown rollers 43 and 43A while the rollable trolleys 44 and 46 similarly respectively support reverse crown roller pairs 45 and 45A, and 47 and 47A. Referring specifically to FIG. 4, the reverse crown rollers 43, 43A, 45, 45A, 47, and 47A nestingly receive the upwardly crowned roller track surfaces of roller carrying rungs 10, 12, and 14 for securely rollably positioning and lateral tracking of the rollers. Each of the rollable trolleys 42, 44, and 46 preferably further has a retainer roller 76 mounted thereon, such retainer rollers 76 protectively rollably biasing against flanges 24 for prevention of derailings of the overlying reverse crown rollers.

Referring further simultaneously to FIGS. 1-4, the preferred embodiment of the instant inventive door assembly preferably further comprises a three elevator door panels 54, 56, and 58, such panels being respectively fixedly attached to rollable carriages 42, 44, and 46 by fasteners 72, the panels 54, 56, and 58 respectively suspending downwardly to floor level from the rollable carriages 42, 44, and 46.

Referring further simultaneously to FIGS. 1-4, the ladder frame's rail means preferably further comprises at least a first, and preferably a pair of medial bolt and spacer combinations 30 and 32, the bolts of such combinations extending through series of longitudinally aligned apertures (not within views) extending through the door assembly support rung 2, and through a plurality of rungs among the roller carrying rungs 10, 12, and 14. Such medially installed bolt and spacer sleeve combinations 30 and 32 advantageously function to medially support the roller carrying rungs through which they pass.

Referring further simultaneously to FIGS. 1-4, the depicted elevator door assembly consisting of ladder frame rungs 10, 12, and 14, trolleys 42, 44, and 46, and door panels 54, 56, and 58 is preferably mirroringly matched with a substantially identical assembly consisting of a door assembly support rung 4, three roller carrying rungs 16, 18, and 20, three rollably mounted rollable trolleys 48, 50, and 52; and three matchingly suspended elevator door panels 60, 62, and 64. As can be specifically seen in FIG. 4, the distal-most or lead rollable trolleys 46 and 48 include exaggerated upward extensions, and the door assembly support rung 4 similarly includes an extended upper flange 8. Such upward extensions and upper flange 8 beneficially provide mounting surfaces for installation of door opening and closing electric motor, pulley assemblies, and shaft door engaging clutch assemblies, such assemblies being conventionally known to those skilled in the art, and which are not depicted in the views.

As stated above, the door assembly support rung 2 is preferably mounted so that it overlies an upper or lower elevator shaft entry. Where such rung is installed over an upper entry a substantially identical assembly is preferably similarly mounted over a lower shaft entry, and vice versa. Accordingly, the assembly depicted in FIGS. 1-4 is representative of a larger, at least triple, installation applicable to an elevator's cab entry and to upper and lower shaft entries. As can be seen in FIG. 4, the door assembly support rung 2 has an inwardly extending flange 3 and has an upwardly extending flange 7, the inwardly extending flange 3 having an upwardly facing surface 5 and the upwardly extending flange 7 having an outwardly facing surface 9. Space 11 is bounded by such surfaces 5 and 9, and such space 11 is representative of and is occupied by portions of the walls of the overlying upper or lower (as the case may be) elevator shaft entries which are described above. Such elevator shaft wall portions 11 are further identified in FIG. 4 with dashed lines. Referring further to FIG. 2, it can be seen that the elevator door panels 54, 56, and 58 are depicted in their extended elevator shaft entry closing positions. While the such door panels 54, 56, and 58 occupy such extended position, they function to close or cover such upper or lower elevator shaft entries. Upon retracting movement of the door panels 54, 56, and 58 to the positions depicted in FIG. 1, they open or uncover such upper or lower elevator shaft entries.

Similarly with the door assembly support rung 2 depicted in FIG. 4, the oppositely positioned door assembly support rung 4, also depicted in FIG. 4, has an inwardly extending flange 13 and has the upper flange 8, the inwardly extending flange 13 having an upwardly facing surface 15, and the upper flange 8 having an inwardly facing surface 17. Space 19 is bounded by such flange surfaces 15 and 17 and such space 19 is representative of and is occupied by a portion of the wall of the elevator cab which is described above. Such elevator cab portion 19 is further identified in FIG. 4 with dashed lines. Extension and retraction of door panels 60, 62, and 64 between the closed position depicted in FIGS. 2 and 3, and the opened position depicted in FIG. 1 alternately covers and uncovers the elevator cab entry described above. Where a building and elevator shaft has levels and entries in addition to a basic upper and lower entry configuration, the shaft entry assembly depicted in FIGS. 1-4 is preferably replicated for additional application to such additional levels and entries.

As can be seen in FIGS. 1-4, the instant inventive elevator door assembly advantageously provides a mechanically simple ladder frame roller track structure which includes economically obtained and fabricated roller carrying rungs and rail means structures. The invention allows an elevator manufacturer and fabricator to economically maintain large inventories of relatively few discreet types of parts. The mechanical simplicity of the replicated ladder frame configuration provides additional economies in reducing time and labor involved in elevator door assembly and installation.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A door assembly for an elevator, the elevator comprising a cab having a cab entry, the elevator further comprising an elevator shaft having an upper shaft entry and a lower shaft entry, the door assembly comprising:

(a) first, second, and third ladder frames, each ladder frame having proximal and distal ends, and comprising a plurality of roller carrying rungs and a door assembly support rung positioned proximally from said each ladder frame's plurality of roller carrying rungs, said each ladder frame further comprising rail means spanning between and rigidly interconnecting said each ladder frame's roller carrying rungs and door assembly support rung, the first ladder frame overlying and extending longitudinally outwardly from the elevator's cab entry, the second ladder frame overlying and extending longitudinally inwardly from the elevator's upper shaft entry, and the third ladder frame overlying and extending longitudinally inwardly from the elevator's lower shaft entry;

(b) first, second, and third pluralities of rollable trolleys respectively mounted upon the first, second, and third ladder frame's pluralities of roller carrying rungs; and (c) first, second, and third pluralities of door panels respectively suspending from the first, second, and third pluralities of rollable trolleys; and (d) a first pair of pluralities of longitudinally aligned bolt receiving apertures, a second pair of pluralities of longitudinally aligned bolt receiving apertures, and a third pair of pluralities of longitudinally aligned bolt receiving apertures, the first, second, and third pairs of pluralities of longitudinally aligned bolt receiving apertures respectively extending through the first, second, and third ladder frames' rungs, the first, second, and third ladder frame's rail means respectively comprising first, second, and third pairs of bolt and spacer sleeve combinations, said pairs of bolt and spacer sleeve combinations respectively extending through the first, second, and third pairs of pluralities of longitudinally aligned bolt receiving apertures.

2. The door assembly of claim 1 wherein each rung among the first, second, and third ladder frame's pluralities of roller carrying rungs comprises a beam having a crowned flange and further having a downwardly extending web.

3. The door assembly of claim 1 wherein each rung among the first, second, and third ladder frames' pluralities of roller carrying rungs is substantially laterally co-extensive with each other roller carrying rung.

4. The door assembly of claim 1 wherein the longitudinally outward extension of the first ladder frame, and the longitudinally inward extensions of the second and third ladder frames are cantilevered.

5. The door assembly of claim 2 wherein each beam comprises an inverted "J" beam.

6. The door assembly of claim 2 wherein each rollable trolley among the first, second, and third pluralities of rollable trolleys comprises a plurality of reverse crown rollers.

7. An elevator door assembly comprising:

(a) a ladder frame having proximal and distal ends, and comprising three roller carrying rungs and a door assembly support rung, the door assembly support rung being positioned proximally from the three roller carrying rungs, and rail means spanning between and rigidly interconnecting the roller carrying rungs and the door assembly supporting rung;

(b) three rollable trolleys, each rollable trolley being mounted upon one of the roller carrying rungs among the three roller carrying rungs;

(c) three door panels, each door panel suspending from one of the rollable trolleys among the three rollable trolleys; and (d) at least a pair of quadruples of longitudinally aligned bolt receiving apertures extending through the door assembly support and roller carrying rungs, the rail means comprising at least a pair of bolt and spacer sleeve combinations extending through the at least pair of quadruples of longitudinally aligned bolt receiving apertures.

8. The elevator door assembly of claim 7 wherein each rung among the three roller carrying rungs comprises a beam, each beam having a crowned flange and a downwardly extending web.

9. The elevator door assembly of claim 7 wherein each roller carrying rung among the three roller carrying rungs is substantially laterally co-extensive with each other roller carrying rung.

10. The elevator door assembly of claim 8 wherein each beam comprises an inverted "J" beam.

11. The elevator door assembly of claim 10 wherein each rollable trolley among the three rollable trolleys comprises a plurality of reverse crown rollers.

* * * * *